United States Patent [19]

Berfield et al.

[11] Patent Number: 4,683,608

[45] Date of Patent: Aug. 4, 1987

[54] ALTERNATE BLOWER OUTLET FOR VACUUM CLEANER

[75] Inventors: Robert C. Berfield, Jersey Shore; Ronald F. Meland, Muncy, both of Pa.

[73] Assignee: Shop-Vac Corporation, Williamsport, Pa.

[21] Appl. No.: 823,049

[22] Filed: Jan. 27, 1986

[51] Int. Cl.[4] ..... A47L 5/36

[52] U.S. Cl. ..... 15/328; 15/327 D

[58] Field of Search ..... 15/331, 328, 327 D, 15/330

[56] References Cited

U.S. PATENT DOCUMENTS

| | | | |
|---|---|---|---|
| 2,027,158 | 1/1936 | Forsberg | 15/330 X |
| 2,751,038 | 6/1956 | Acheson | 15/330 X |
| 2,757,753 | 8/1956 | Kasper | 15/330 X |
| 2,905,267 | 9/1959 | Thompson | 15/330 X |
| 3,924,291 | 12/1975 | Tschudy et al. | 15/330 |

*Primary Examiner*—Chris K. Moore

*Attorney, Agent, or Firm*—Ostrolenk, Faber, Gerb & Soffen

[57] ABSTRACT

High velocity exhaust air from within a vacuum cleaner is directed radially outwardly from a motor-driven impeller into a first duct. A second duct is provided that includes an effective large area opening for permitting exhaust air to diffuse quietly to the external atmosphere. A valve arrangement is provided for interconnecting the first duct alternately to a hose receptacle opening in which an outlet hose may be placed, or to the second duct to ensure especially quiet operation of the vacuum cleaner. The valve arrangement may comprise a chamber in flow communication with the first duct and having two, alternate outlets: the hose receptacle opening and a second opening leading into the second duct. A hinged door may be utilized for normally blocking the hose receptacle opening, but which is moved into sealing relation with the second opening simply by insertion of an end of an outlet hose into the hose receptacle opening.

17 Claims, 3 Drawing Figures

320
330
TO DUCT-36
34
CHAMBER
30
200
210
28
32
FROM
DUCT-26

320
330
200
34
CHAMBER
30
310
28
300
32
FROM
DUCT-26

ALTERNATE BLOWER OUTLET FOR VACUUM CLEANER

BACKGROUND AND SUMMARY OF THE INVENTION

The invention relates to a vacuum cleaner, are more particularly to a blower outlet for a vacuum cleaner having a hose receptacle opening in which an outlet hose may be placed.

Vacuum cleaners operate through rapid movement of air, which may cause considerable and irritating noise. In typical operation, a vacuum cleaner draws external air into a debris container by suction. The external air, which may be laden with debris or dirt that may be wet or dry, is filtered within the vacuum cleaner to remove the debris or dirt and is then exhausted from the vacuum cleaner. To ensure quiet operation of a vacuum cleaner, exhaust air, which is typically impelled at high velocity, is preferably diffused into the external atmosphere through a large opening or series of openings. However, it is also desirable to be able to use the high velocity exhaust air from a vacuum cleaner by directing it through an outlet hose which enables a user to direct the high velocity air at any desired location. It would thus be desirable to provide a vacuum cleaner that is quiet in operation, but which may be used with an outlet hose for directing exhaust air through the hose.

Accordingly, it is an object of the invention to provide a vacuum cleaner that is quiet in operation but which may be used with an outlet hose.

A further object of the invention is to provide a vacuum cleaner having the foregoing attributes and which additionally requires of a user only the simple insertion or removal of an outlet hose into a hose receptacle opening in the vacuum cleaner to use the outlet hose while enduring quiet operation of the vacuum cleaner.

Another object of the invention is to provide a vacuum cleaner in which especially quiet operation is achieved when an outlet hose is not being used with the vacuum cleaner.

In a preferred form, the present invention relates to a vacuum cleaner having an inlet leading into a collection chamber, a motor driven fan for withdrawing air from the collection chamber and directing it at high speed into a first duct. The vacuum cleaner further includes a second duct in switchable flow communication with the first duct and including an opening of effective large area, such as a plurality of spaced openings, through which air injected from the first duct may diffuse quietly into the external atmosphere. A valve means is included for interconnecting the first duct alternately to a hose receptacle opening, when an outlet hose is to be used, or to the second duct, when especially quiet operation of the vacuum cleaner is desired since exhaust air is then quietly diffused through the spaced openings in the second duct to the external atmosphere.

In preferred form, the foregoing valve means comprises a chamber in flow communication with the first duct and the hose receptacle opening and a second opening leading into the second duct. A hinged door is preferably included within the chamber with the door hinged in such a way as to normally block the hose receptacle opening and direct air injected from the first duct through the second opening and into the second duct where it is then quietly diffused into the external atmosphere. When it is desired to utilize an outlet hose with the vacuum cleaner, an end of the outlet hose is inserted into the hose receptacle opening, whereupon such hose end pushes the hinged door to a predetermined position within the chamber where the door blocks the second opening and causes air injected from the first duct to pass into the outlet hose for use as desired.

Other objects, features and advantages of the invention will become apparent from the following description of the preferred embodiments of the invention, considered in conjunction with the accompanying drawings and the appended claims.

DESCRIPTION OF THE PREFERRED EMBODIMENTS

Figure 1:
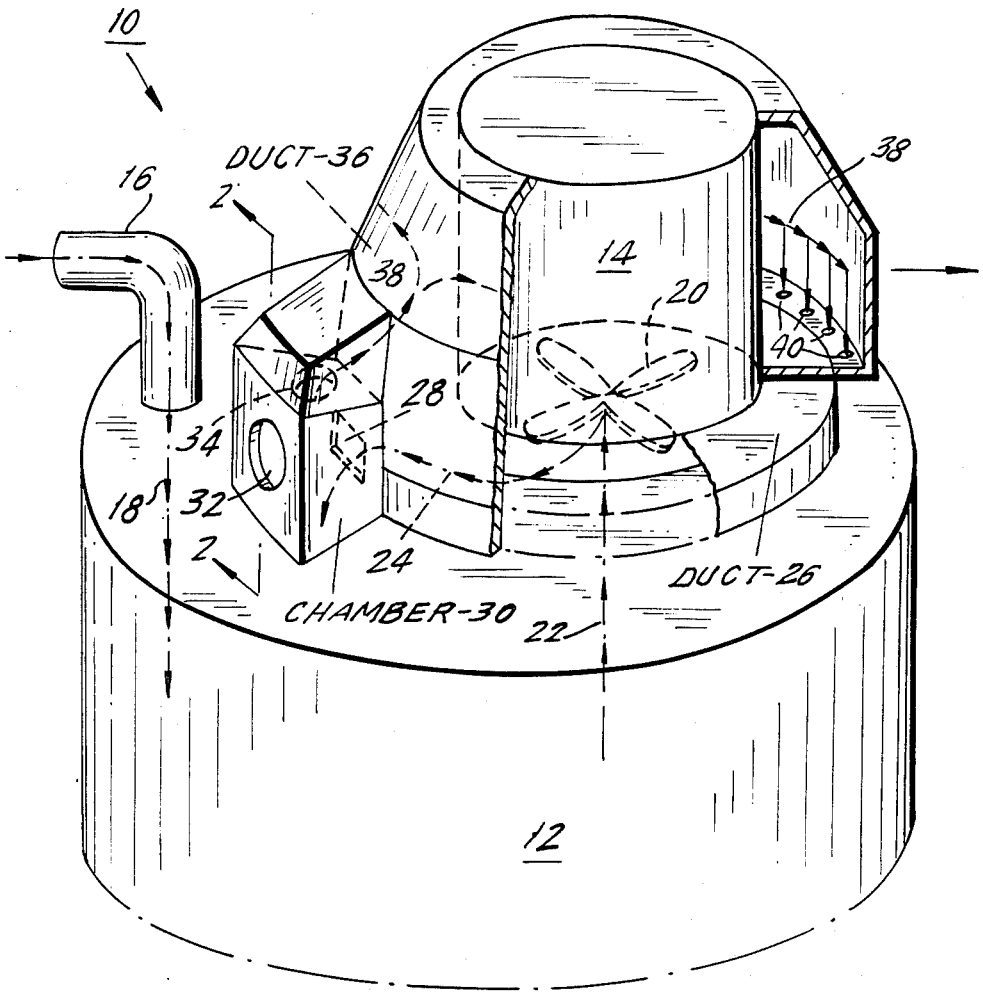
FIG. 1 is a schematic view in perspective of a vacuum cleaner in accordance with the present invention.

FIG. 1 shows a schematic view in perspective of a vacuum cleaner 10 in accordance with the present invention. The vacuum cleaner 10 is of the canister type and includes a canister 12 with a motor 14 mounted thereon. Inlet air which may contain dirt or solid or liquid debris is drawn into vacuum cleaner 10 through an inlet 16, following the path indicated by arrows 18. Once inside canister 12, dirt or debris in the inlet airstream at 18 falls to the bottom of the canister in accordance with the well known phenomenon of air pressure drop encountered by inlet air 18 as it enters canister 12.

The motor 14 drives a centrifugal fan 20, which draws air upwardly from within canister 12 as illustrated by arrows 22. Centrifugal fan 20 is shown in schematic form for convenience of illustration, and suitably comprises a conventional impeller fan of the centrifugal type. Airstream 22 is filtered in a conventional manner by passing through a filter (not shown) located within canister 12. The airstream 22 is deflected by fan 20 as high velocity airstream 24, which is impelled by the fan into a first duct 26. Duct 26 is located directly outward from fan 20. Airstream 24 is directed by the first duct 26 through an opening 28 and into a chamber 30. Once inside chamber 30, airstream 24 can exit from either a hose receptacle opening 32 to the external atmosphere, or an opening 34 into a second duct 36. The means by which airstream 24 is directed to flow through opening 32 or opening 34 is described below in connection with important features of the invention.

If airstream 24 is directed through second opening 34 into second duct 36, it then flows through the second duct as represented by arrows 38. Once inside duct 36, airstream 38, which typically is flowing at a rapid velocity, is quietly diffused through spaced openings 40, which are preferably directed downwardly and positioned radially outwardly from first duct 26.

Figure 2:
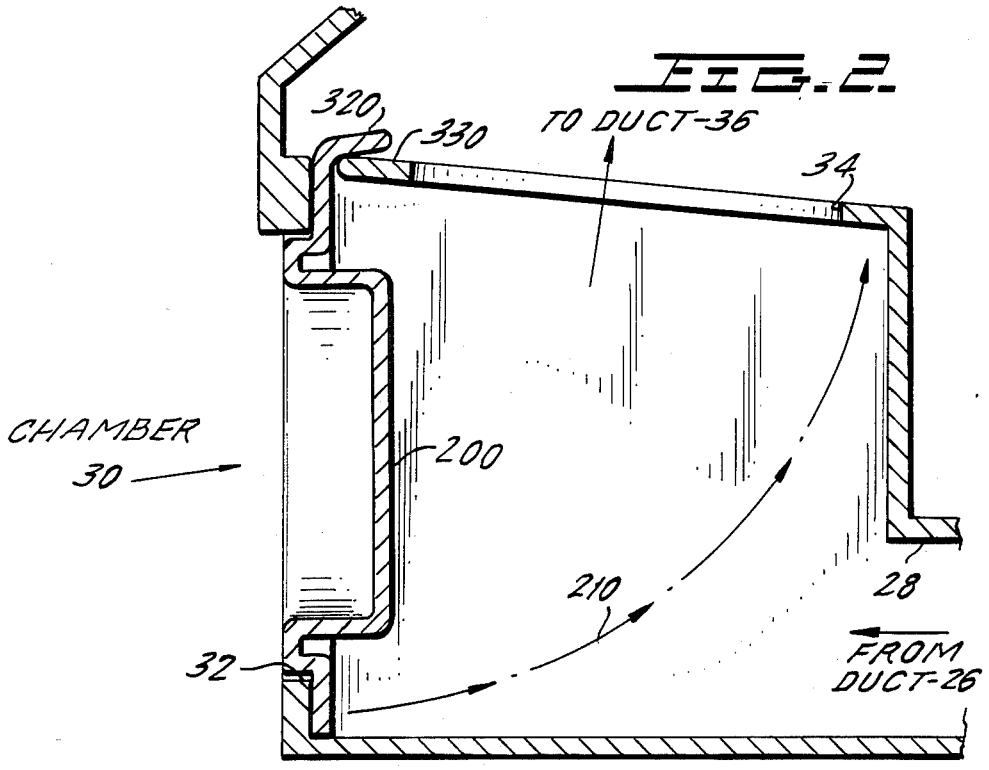
FIG. 2 is a cross-sectional view of a chamber of the vacuum cleaner of FIG. 1, taken at lines 2—2 in FIG. 1 and illustrating features of the present invention.

Chamber 30 is illustrated in a cross-sectional view in FIG. 2, which is taken at lines 2—2 in FIG. 1. In FIG. 2, opening 28 from duct 26 is shown, together with hose receptacle opening 32 and opening 34 leading to duct 36. A hinged door 200 is arranged to swing in an arc represented by arrows 210. Door 200 is illustrated at the leftmost position of its arc where it seals hose receptacle opening 30 from the external environment. When door 200 seals opening 30, air that enters chamber 30 from duct 26 is forced to pass upwardly through opening 34 to duct 36. Once in duct 36, the air, which is at high velocity, is channeled in such a way as to quietly diffuse through openings 40 of duct 36 shown in FIG. 1.

Figure 3:
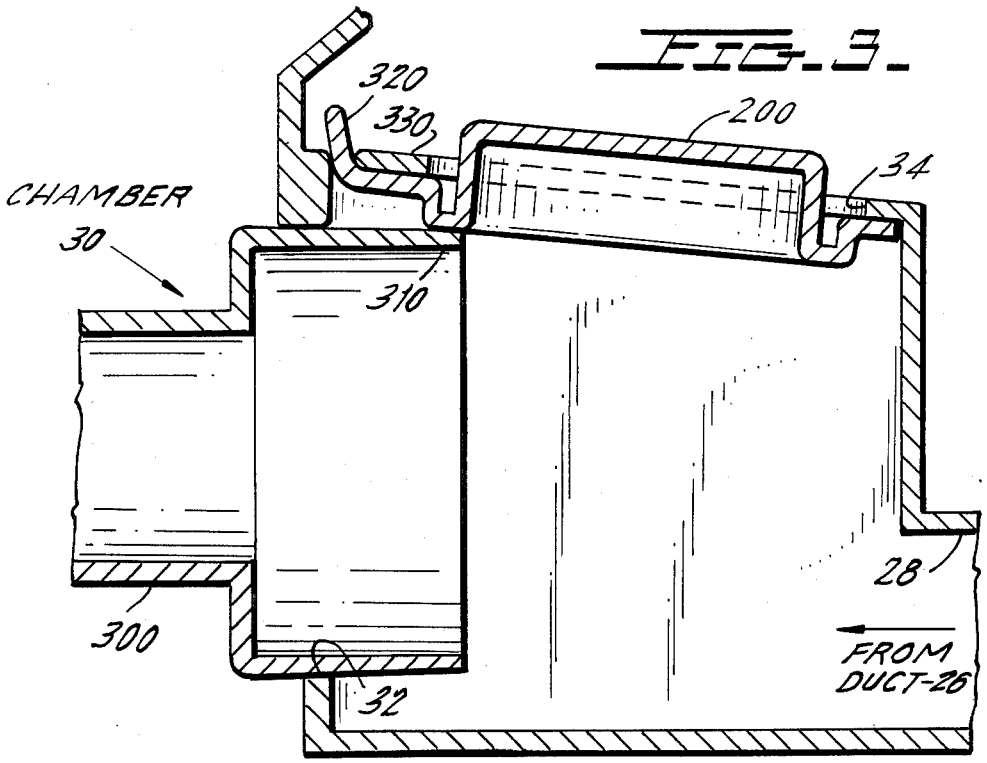
FIG. 3 is a view similar to FIG. 2 illustrating a chamber of the vacuum cleaner of FIG. 1 when an outlet hose is inserted into the chamber.

FIG. 3 illustrates the position of hinged door 200 in chamber 30 when an outlet hose 300 is inserted into hose receptacle opening 32. Hinged door 200 is forced to its rightmost extreme position as illustrated by simple insertion of an end 310 of outlet hose 300 into hose receptacle opening 32. In particular, hose end 310 pushes hinged door 200 towards the extreme right at which position the door effectively seals opening 34. The hinge arrangement for door 200 comprises a hinge member 320 of door 200 which revolves around a stationary hinge member 330.

Thus, with hose 300 inserted into hose receptacle opening 32 and chamber opening 34 blocked, air injected into chamber 30 from duct 26 passes into outlet hose 300 where it can then be directed as desired. Generally quiet operation of the vacuum cleaner described herein results when air passes through hose 300, since the hose acts in a customary capacity of baffling noise.

The foregoing describes a vacuum cleaner including a debris container and a motor driven fan for withdrawing air from the container. A chamber is provided in which an outlet hose may be inserted, and the mere insertion of an end of the hose into the chamber causes high velocity air impelled by the fan to be directed into the hose for use as desired. Removal of the hose from the chamber automatically results in high velocity air from the fan being directed into a duct having spaced holes through which the high velocity air may be quietly diffused.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. In a vacuum cleaner having an inlet leading into a collection chamber, a fan for withdrawing air from the collection chamber and directing it at high speed into a first duct, and a motor for driving the fan, the improvement, in combination with the foregoing, comprising:

a second duct positioned above the first duct and in switchable flow communication therewith, the second duct including an effective large area opening through which air injected from the first duct may diffuse quietly into the external atmosphere; and valve means for interconnecting the first duct alternately to a hose receptacle opening when an outlet hose is to be used or to the second duct to ensure quiet operation of the vacuum cleaner by diffusing exhaust air through the effective large area opening in the second duct.

2. The apparatus of claim 1, wherein the valve means is responsive to insertion of an outlet hose into the hose receptacle opening.

3. The apparatus of claim 2, wherein the valve means includes a chamber comprising:

a first opening to the first duct;

closable second and third openings to the hose receptacle opening and to the second duct, respectively; and means to alternately close the second or third openings.

4. The apparatus of claim 3, wherein the means to alternately close the second or third openings comprises a hinged door.

5. The apparatus of claim 4, wherein the hinged door is arranged with respect to the hose receptacle opening in such a way that the mere insertion of an end of an outlet hose into the hose receptacle opening is sufficient to cause the hinged door to swing into a position to block the third opening and cause air from the first opening to be directed out the outlet hose.

6. The apparatus of claim 4, wherein the hinged door is positioned sufficiently close to the hose receptacle opening such that an end of an outlet hose which is inserted into the hose receptacle opening can directly contact the hinged door and push the door into sealing contact with the third opening.

7. The apparatus of claim 1, wherein the fan comprises a centrifugal fan.

8. The apparatus of claim 7, wherein the first and second ducts define generally annular volumes at least partially encompassing the lateral periphery of the motor.

9. The apparatus of claim 1, wherein the effective large area opening of said second duct comprises a plurality of spaced openings through which air injected into the second duct quietly diffuses from the duct.

10. The apparatus of claim 9, wherein:

the first duct extends radially outwardly from the fan; and the spaced openings in the second duct are directed downwardly and are spaced radially outwardly from the first duct.

11. In a vacuum cleaner having an inlet leading into a collection chamber, a centrifugal fan for withdrawing air from the collection chamber and directing it radially outwardly from the fan at high speed directly into a first duct, and a motor for driving the fan, the improvement, in combination with the foregoing, comprising:

a second duct positioned atop the first duct and being in switchable flow communication therewith, the second duct defining a generally annular volume at least partially encompassing the lateral periphery of the motor and including a plurality of spaced openings through which air injected from the first duct may diffuse relatively quietly into the external atmosphere; and valve means for interconnecting the first duct alternatively to a hose receptacle opening for receiving an end of an outlet hose or to the second duct to ensure quiet operation of the vacuum cleaner by diffusing exhaust air to the external atmosphere through the spaced openings in the second duct.

12. The apparatus of claim 11, wherein the valve means is responsive to insertion of an outlet hose into the hose receptacle opening.

13. The apparatus of claim 12, wherein the valve means includes a chamber comprising:

a first opening to the first duct;

closable second and third openings to the hose receptable opening and to the second duct, respectively; and means to alternately close the second or third openings.

14. The apparatus of claim 13, wherein the means to alternatively close the second and third openings comprises a hinged door.

15. The apparatus of claim 14, wherein the hinged door is arranged with respect to the hose receptacle opening in such a way that the mere insertion of an end of an outlet hose into the hose receptacle opening is sufficient to cause the hinged door to swing into a position to block the third opening and cause air from the first opening to flow out the outlet hose.

16. The apparatus of claim 11, wherein the plurality of spaced openings in the second duct are directed downwardly and spaced outwardly of the first duct.

17. The apparatus of claim 1, wherein the fan is positioned to impel air directly into the first duct.

* * * * *